United States Patent [19]

Viel

[11] Patent Number: 4,563,382

[45] Date of Patent: Jan. 7, 1986

[54] OPEN-WORK KNITTED AND BONDED TEXTILE STRUCTURE AND METHOD OF OBTAINING SAME

[75] Inventor: Maurice Viel, Ecully, France

[73] Assignee: Bat Taraflex & Notex S.A., Pontcharra-sur-Turdine, France

[21] Appl. No.: 575,150

[22] Filed: Jan. 30, 1984

[30] Foreign Application Priority Data

Feb. 4, 1983 [FR] France ..... 83 01995

[51] Int. Cl.[4] ..... B32B 27/14

[52] U.S. Cl. ..... 428/198; 66/197; 428/253; 428/296

[58] Field of Search ..... 428/198, 253, 296; 66/197

[56] References Cited

U.S. PATENT DOCUMENTS 4,133,191 1/1979 Blore ..... 66/197

4,241,123 12/1980 Shih ..... 428/296

OTHER PUBLICATIONS

Warp Knit Fabrics for Industrial End-Uses by K. D. Darlington-"Knitted Outerwear Times," Jul. 1, 1968.

*Primary Examiner*—Marion E. McCamish

*Attorney, Agent, or Firm*—Parkhurst & Oliff

[57] ABSTRACT

Open-work textile structure of the type constituted by a warp knit fabric produced with yarns coated with a thermoplastic material, the coating being partly melted and bonding the yarns together in those areas where they are in contact.

According to said structure, the open-work takes in the form of regular polygons of which some of the edges at least are slanted with respect to the length of said structure, the stitches of said knitted fabric imprisoning a weft yarn which extends in substantially a straight line parallel to the edges of the formed open-work.

8 Claims, 4 Drawing Figures

OPEN-WORK KNITTED AND BONDED TEXTILE STRUCTURE AND METHOD OF OBTAINING SAME

Figure 1:
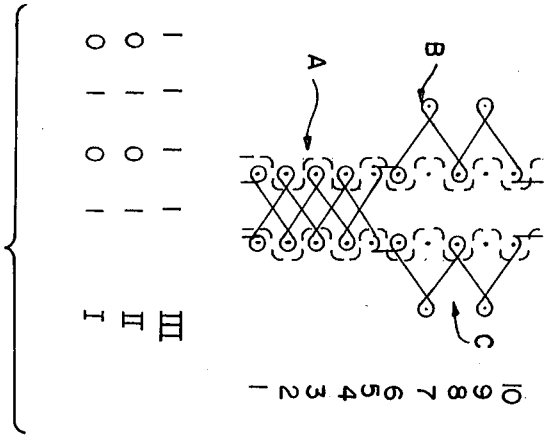

The present invention relates to a new type of open-work textile articles produced on a warp knitting machine; it further relates to a method of obtaining such open-work articles.

Warp-knit articles with a net-like structure are well known to technicians and have been the subject of many publications, among which is an article published in the revue "Knitted Outerwear Times" of July 1968, pages 37 to 40.

The advantage of said articles, over nets conventionally produced by knotting, is that they can be produced at high speed rates, which considerably reduces their cost.

But knitted nets have one disadvantage which is that they can only be produced in relatively small width, varying with the machine used. In addition, except for using complicated weaves or patterns and machines with a considerable amount of guide bars, they have a tendency to loose their shape easily and to show no really homogeneous strength in all directions. Finally, it is well known that some yarns such as glass yarns, carbon yarns, etc. which have much tensile strength and are as a result particularly advantageous for some applications, are not readily usable on knitting machines, because of their brittleness under a bending stress, and the formation of stitches leads to such stresses being created.

It has also been proposed in French Utility Certificate No. 2 250 497 to produce knitted articles, and in particular warp knit type articles using yarns coated with a thermoplastic material. After knitting, the fabric is subjected to a thermal treatment with a view to giving it more rigidity and to obtaining a good cohesion of the whole assembly, to prevent the stitches from undoing. These articles, which especially are used for making curtains, i.e., intended for applications in which the mechanical stresses are small and/or are exerted in a preferential direction of the article (namely longitudinally or crosswise), cannot be successfully used in other fields of application where the fabric is required to have balanced mechanical characteristics both lengthwise and widthwise, if not also on the bias. This is the case, for example, with protection or safety nets, netting used as windshields or as protection against falls, or as reinforcements in laminated materials, etc.

Furthermore, if the object is to obtain non-deformable articles, this implies the formation of a structure fixed on the actual machine and therefore limits the width of the article to that of the machine.

A new type of open-work textile structure has now been found, and is the object of the present invention, which is constituted by a warp knit fabric showing not only great stability but also balanced mechanical properties in virtually all directions (lengthwise, widthwise and on the bias).

The structure according to the invention has the further characteristic of being considerably wider than the knitting width, e.g., two to three times the knitting width, whilst retaining the aforesaid properties.

The invention further relates to a method of obtaining such an open-work textile structure.

In general, the open-work textile structure according to the invention is of the type constituted by a warp-knit fabric produced from yarns which are sheathed with thermoplastic material, the sheath being partly melted and bonding the yarns together in those areas where said yarns are mutually touching, and said structure is characterized in that said knitted fabric is based on a weave using at least three bars, and in that the open-work is in the form of regular polygons, of which certain edges at least are slanted with respect to the length of the structure and that the stitches of said knitted fabric imprison a weft yarn which extends in a substantially straight line in parallel to the edges of the formed open-work.

Different knitted fabric structures may be produced without departing from the invention, depending on the final mechanical characteristics that are required.

For example, according to one embodiment of the invention, the open-work of the structure is hexagonal-shaped, this permitting to obtain virtually identical strengths, lengthwise, widthwise and on the bias.

According to a variant, the open-work is diamond-shaped which gives perfectly balanced properties on the bias.

Suitable yarns to obtain a material according to the invention are the conventional coated yarns whose core may be made from any textile material. But the invention is more particularly adapted to be carried out with high modulus yarns which can be used for industrial applications, for example glass yarns, or highly-resistant chemical yarns such as those found on the market under the trademark KEVLAR, even though these yarns may be fragile under bending stress, since it has been noted that, with the method according to the invention, such yarns can easily be knitted, whereas this was impossible until now.

It is obviously possible, depending on the final results sought and without departing from the invention, to use different types of weaves provided that these weaves enable one to obtain an open-work structure, deformable after knitting; and moreover, the yarns which constitute the structure according to the invention can be either identical for all the guide bars, or optionally made from different materials and this applies both to the core and to the sheath.

As already indicated, the invention also relates to a method of obtaining an open-work textile structure such as defined hereinabove.

In general, the method according to the invention consists in producing a warp knit fabric on a RASCHEL or similar type machine, using yarns coated with a thermoplastic material, and in thermally treating the resulting open-work textile structure, with a view to partly melting the thermoplastic coating and bonding the yarns together in the areas where they are in contact, said method being characterized by the fact:

that the open-work knit thus obtained is based on a weave with at least three bars, two of which at least are threaded 1-in, 1-out and work so as to form a netting, in which the interstices are deformable and polygonal, and can be deformed crosswise, the third bar dispensing a weft yarn;

that upon completion of the knitted fabric, said fabric is drawn crosswise during the thermal treatment in order to give a slanted orientation, with respect to the length of the knitting, to at least part of the open-work or interstices contained therein and to bring the weft yarns in a substantially rectilinear position, in parallel to the edges of the formed open-work.

Preferably, when producing the knitted fabric, the machine is adjusted so as to have a loose structure with loose stitches, this being obtained for example by increasing the rate and/or the casting off to a higher value than that used for producing knitted nets until now.

With this method, it is therefore possible to obtain on a machine of predetermined width, wider articles, two or three times the width of the knitting, the open-work in the completed article being unexpectedly perfectly stabilized, whereas the untreated knitting is very deformable because of its structure, said article also has balanced mechanical properties in all directions (in the length, in the width and on the bias), hence a good isotropy.

The invention will be more readily understood on reading the following description with reference to the four accompanying drawings, which are conventional illustrations of warp knit articles readily reproduceable by anyone skilled in the art.

The four examples of embodiments shown in FIGS. 1–4 and described in detail hereinafter, all of which relate to an open-work textile structure according to the invention, have used a 12-gauge RASCHEL machine, (i.e., with 12 needles in 25.4 mm), the supply yarns being coated yarns with a core of high-tenacity polyester (1100 decitex) coated with PVC in the proportion of 30% polyester for 70% PVC by weight.

EXAMPLE 1

This example illustrates, with reference to FIG. 1, an open-work textile structure according to the invention obtained from a knitting with a three-bar weave.

The front bars (I and II) are threaded 1-in, 1-out, and work so as to form a net in which the interstices are deformable if the fabric is pulled in any way. This type of net structure is not really suitable for industrial use due to the aforesaid deformability.

In the present case, the yarns of bars (I) and (II) work according to the following weaves:

bar (I): 4.6/4.2/4.6/4.2/4.6/6.4/6.8/6.4/6.8/6.4.

bar (II): 4.2/4.6/4.2/4.6/4.2/2.4/2.0/2.4/2.0/2.4.

Concerning bar (III), this is fully threaded and works according to a weft weave 2.2/0.0. The resulting fabric is thereafter treated on tenters where it is widened about 2.5 times and subjected to a temperature of about 135° C. for one minute, this causing partial melting of the PVC coating and bonding the yarns together at their touching point.

This tentering gives to the open-work in the knitting a regular hexagonal appearance. The edges constituted by the parts corresponding to zone A in FIG. 1 are disposed lengthwise of the fabric, whereas the edges corresponding to zones B and C of same Figure are on the bias with respect to the length of the article. Moreover, the yarns of bar III, which are weft working on one needle, are brought substantially in a straight line with respect to the edges of the formed open-work.

The article thus obtained shows excellent stability whereas the starting knitted fabric is in itself extremely deformable, said article showing balanced mechanical properties either lengthwise, widthwise or on the bias.

EXAMPLE 2

Figure 2:
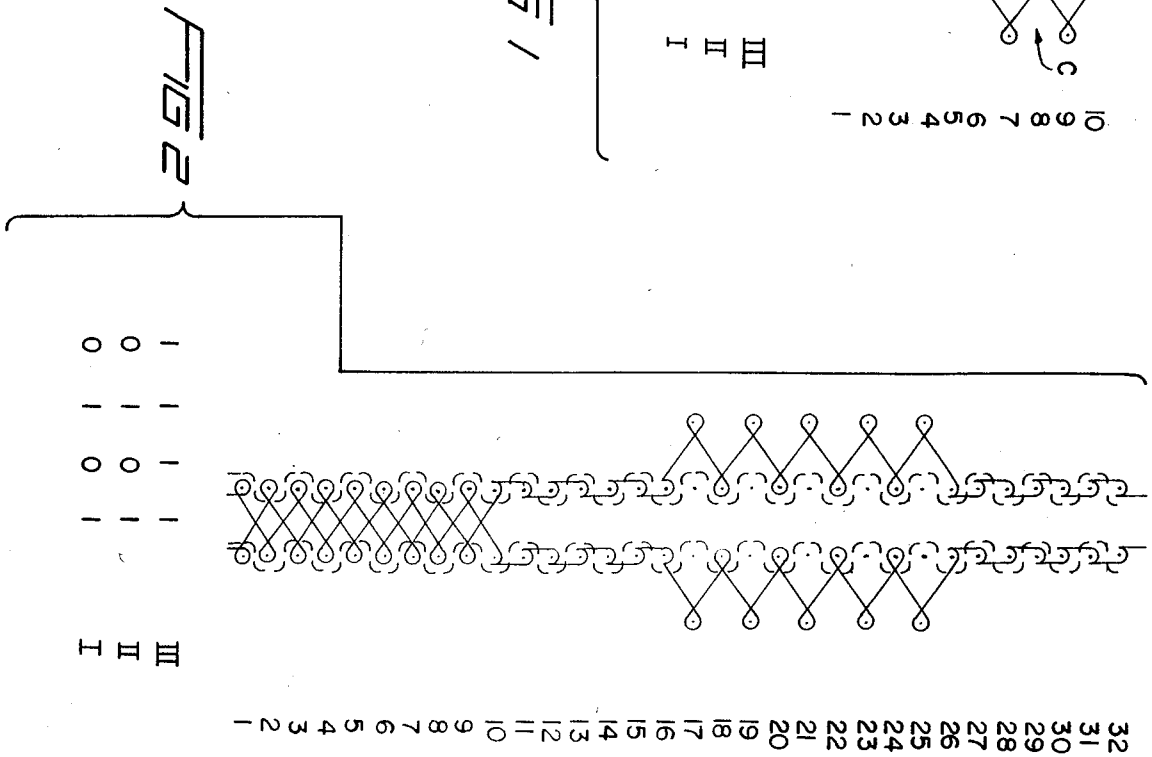

This example illustrated by FIG. 2 is comparable to Example 1, but differs in that the weave ratio is 32 courses instead of 10. An open-work textile structure is also obtained in this case, in which the open-work is hexagonal-shaped, and the edges of the interstices extend both lengthwise and obliquely, and in which the yarns of bar (III) which form the wefts, are substantially in alignment with the edges of said interstices.

EXAMPLE 3

Figure 3:
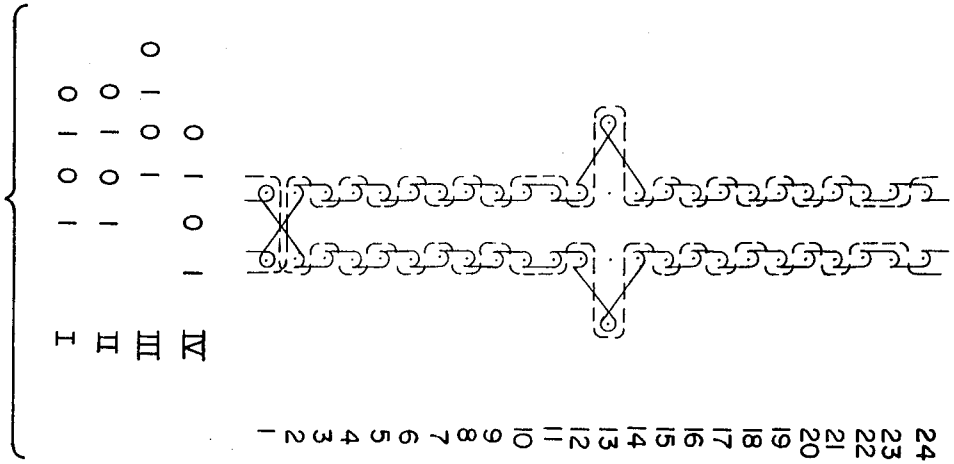

This example illustrated by FIG. 3 shows an open-work textile structure according to the invention produced from a four-bar weave.

As in the preceding examples, bars (I) and (II) form the open-meshed structure of the knitting, whereas bars (III) and (IV) are threaded 1-in:1-out and work as a filling weave.

Compared with the articles obtained according to Examples 1 and 2 above, this open-work textile structure has, after widening and thermal treatment, a diamond-shaped open-work, the weft yarns extending substantially in a straight line inside the knitting.

EXAMPLE 4

Figure 4:
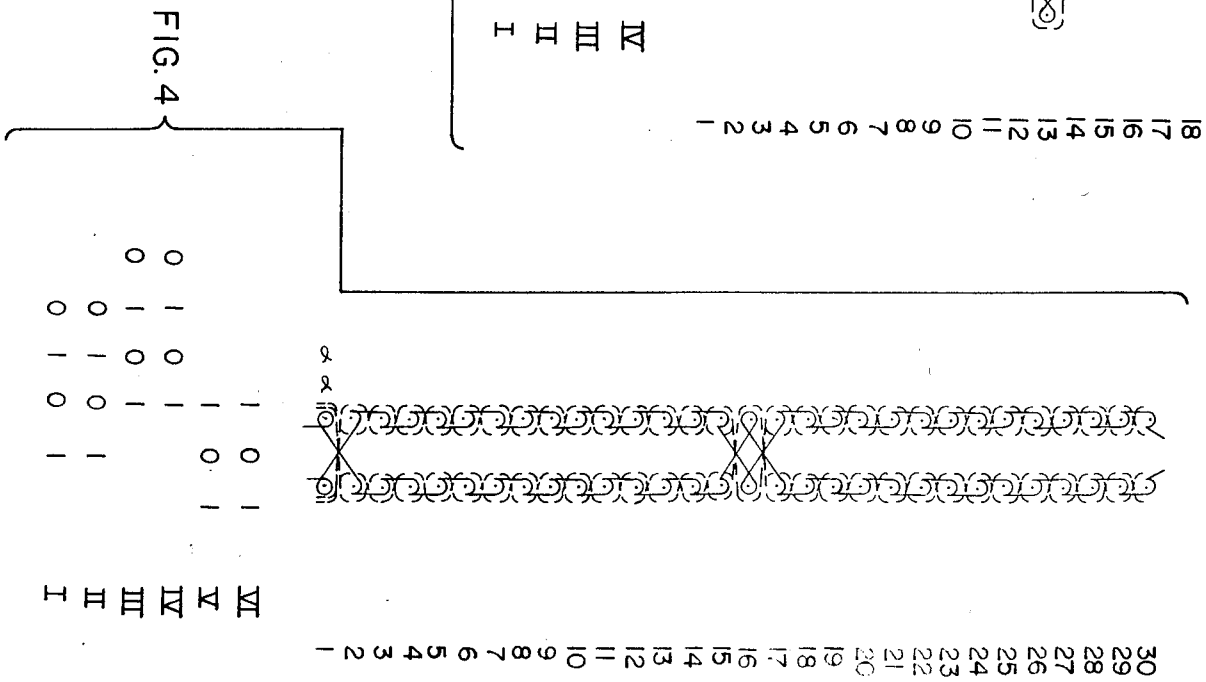

This example, illustrated by FIG. 4, is a variant permitting to obtain a diamond-shaped open-work textile structure.

In this weave, bars (I) and (II) form the meshed structure whereas bars (III), (IV), (V) and (VI) work as a filling weave. After widening and thermal treatment of the knitting, the article obtained is perfectly stable and balanced.

The articles obtained according to the invention are suitable for numerous applications and can also be used, as they are, as protection nets against winds, against falls, and as geotextile articles.

They can also be used as reinforcements for laminated articles, etc.

Obviously, the invention is not limited to the examples given hereinabove and on the contrary covers any variants thereof which remain within its scope or its spirit.

For example, although in the described examples, the knitted fabric is obtained on a one-needle Raschel machine, it could also be possible to produce tubular knitted fabrics on two-needle Raschel machines, the resulting article being either used in its tubular shape, or optionally cut along a generating line, to double the width of the finished article.

Also, the articles according to the invention could also be produced on any other warp knit machines such as warp looms or crocheting machines.

It is further possible, by combining different weaves, to obtain open-work with interstices shaped differently one from the other, alternating for example diamond and hexagonal shapes.

An although it may be preferable to produce articles constituted entirely of yarns coated with a thermo-adhesive material, it is also possible for only some of the yarns to be so coated, for example the weft yarns, or to have only two bars working reversedly and forming stitches.

In addition to the special characteristics resulting from the actual structure of the article according to the invention, the presence of a thermo-adhesive coating affords very good protection against bad weather, ultraviolet rays, and even against coloring effects.

Finally, although the yarns used are only externally coated with a thermoplastic material, it is also possible to use any other equivalent type of yarns, even yarns made entirely of a thermoplastic material. Likewise, although the thermal treatment to which the articles is subjected is such that there is only partial melting of the thermoplastic coating, this for the purpose of keeping the article relatively supple, it is also possible to apply the said treatment longer if the object is to obtain more rigidity.

What we claim is:

1. An open-work textile structure of the warp-knit type using yarns coated with a thermoplastic material to produce a knitted fabric based on a weave using at least three bars and having an open-work structure in the form of regular polygons at least certain edges of which are slanted with respect to the length of the structure, wherein the stitches of the knitted fabric imprison a weft yarn which extends in a substantially straight line in parallel to the edges of the formed open-work, and wherein said coating is partly melted and resolidified to bond the yarns together in those areas where they are in contact.

2. An open-work textile structure as claimed in claim 1, wherein the open-work is hexagonal-shaped with two edges parallel to the length direction of the fabric, the other edges being slanted with respect to said direction.

3. An open-work textile structure as claimed in claim 1, wherein the open-work is diamond-shaped.

4. A method of obtaining an open-work textile structure as claimed in claim 1, consisting in producing a warp-knit fabric from yarns coated with a thermoplastic material, and in thermally treating the resulting open-work textile structure so as to partly melt the thermoplastic coating with a view to bonding the yarns together in those areas where said yarns are in contact, the method comprising:

producing an open-work knit based on a weave with at least three bars, at least two of which are threaded 1-in, 1-out and worked so as to form a netting, in which the interstices are deformable and polygonal, and can be deformed crosswise, the third bar dispensing a weft yarn;

upon completion of the knitted fabric, drawing said fabric crosswise in order to give a slanted orientation, with respect to the length of the knitting, to at least part of the open-work or interstices contained therein, and to bring the weft yarns into a substantially rectilinear position in parallel to the edges of the formed open-work, while subjecting the thermoplastic material to a heat treatment to cause it to bond the yarns at points of mutual contact.

5. A method as claimed in claim 4, wherein a machine weaving the fabric is so adjusted as to obtain a loose structure with loose stitches.

6. An open-work textile structure of the warp-knit type produced according to the method comprising:

warp-knitting yarns having a thermoplastic coating to form an open-work knit fabric based on a weave using at least three bars and producing an open-work in the form of regular polygons and wherein the stitches of the knitted fabric imprison a weft yarn;

stretching the thus-formed fabric crosswise to give a slanted orientation to at least certain edges of the open-work and to bring the imprisoned weft yarn substantially in parallel to the edges of the thus formed open-work;

subjecting the thus-stretched fabric to heat treatment so as to fuse together the thermoplastic material on the yarns at points of mutual contact therebetween.

7. The open-work textile structure of claim 6, wherein the open-work is hexagonally shaped, with two edges in parallel to the length of the fabric, and the other edges slanted with respect to the length of the fabric.

8. The open-work textile structure of claim 6, wherein the open-work is diamond shaped.

* * * * *